US011805876B2

(12) United States Patent
Chang

(10) Patent No.: US 11,805,876 B2
(45) Date of Patent: Nov. 7, 2023

(54) BAG SET AND USAGE METHOD THEREOF

(71) Applicant: BITPLAY INC., Taipei (TW)

(72) Inventor: Chia-Wei Chang, Taipei (TW)

(73) Assignee: BITPLAY INC., Taipei (TW)

( * ) Notice: Subject to any disclaimer, the term of this patent is extended or adjusted under 35 U.S.C. 154(b) by 407 days.

(21) Appl. No.: 17/124,541

(22) Filed: Dec. 17, 2020

(65) Prior Publication Data

US 2022/0000236 A1 Jan. 6, 2022

(30) Foreign Application Priority Data

Jul. 2, 2020 (TW) ..... 109208448

(51) Int. Cl.

| | |
|---|---|
| ***A45F 3/02*** | (2006.01) |
| ***A45C 3/00*** | (2006.01) |
| ***A45C 13/00*** | (2006.01) |
| ***A45C 7/00*** | (2006.01) |
| *A45C 11/22* | (2006.01) |

(52) U.S. Cl.

CPC ..... *A45C 13/008* (2013.01); *A45C 7/0086* (2013.01); *A45F 3/02* (2013.01); *A45C 11/22* (2013.01)

(58) Field of Classification Search

CPC ..... A45C 7/0086; A45C 13/008; A45C 11/22; A45F 3/02; A45F 2005/026

USPC ..... 224/583, 616, 617, 579, 272, 197, 198, 224/199, 200, 183; D3/215, 226; 24/DIG. 60

See application file for complete search history.

(56) References Cited

U.S. PATENT DOCUMENTS 4,995,436 A * 2/1991 Cantor ..... A45C 7/0086 190/110
5,201,858 A * 4/1993 Otrusina ..... A45F 5/02 24/3.1
5,358,159 A * 10/1994 Lundie, Jr. ..... F41C 33/046 224/640
5,604,958 A * 2/1997 Anscher ..... A45C 7/0086 24/165
5,628,443 A * 5/1997 Deutsch ..... A45F 3/00 190/110

(Continued)

FOREIGN PATENT DOCUMENTS

CN 212787749 U * 3/2021 ..... A45C 13/008
DE 3600794 C2 * 3/1988

(Continued)

*Primary Examiner* — Justin M Larson
(74) *Attorney, Agent, or Firm* — BACON & THOMAS, PLLC

(57) ABSTRACT

A bag set comprises a first bag unit combined with a second bag unit. The first bag unit includes a main bag body and a strap set. The main bag body has two first fasteners disposed on an outer surface. The strap set includes a first strap component having two ends connected with the main bag body, and a second strap component having a loop structure and one end connected with the main bag body. The second bag unit has two second fasteners to be attached to or disassembled from the two first fasteners selectively. When in use, the first strap component is hung diagonally on a shoulder of a user; and the second strap component is extended forward from the waist of the user to make the loop structure positioned in front side of the user, to pass the first strap component through the loop structure.

9 Claims, 5 Drawing Sheets

(56) References Cited

U.S. PATENT DOCUMENTS 5,704,528 A * 1/1998 Faure ..... A45F 3/04 190/110
5,743,447 A * 4/1998 McDermott ..... A45C 7/0086 224/583
5,845,833 A * 12/1998 Murphy ..... A45F 3/02 224/625
5,893,503 A * 4/1999 Jean ..... A45F 3/14 224/264
5,934,527 A * 8/1999 Von Neumann ..... A45F 3/042 224/582
5,957,421 A * 9/1999 Barbour ..... A45F 5/02 248/314
5,971,119 A * 10/1999 Chi ..... A45C 13/30 190/110
6,311,884 B1 * 11/2001 Johnson ..... A45F 3/04 224/153
6,530,510 B2 * 3/2003 Ferrari ..... B60R 11/00 224/555
7,124,921 B1 * 10/2006 Hubbell ..... A45F 3/16 224/652
D574,608 S * 8/2008 Menzel ..... D3/222
7,857,181 B2 * 12/2010 Sacks ..... A45F 3/14 224/579
8,302,830 B1 * 11/2012 Jensen ..... A45F 3/02 224/625
8,613,564 B2 * 12/2013 Busch ..... F41C 33/007 403/328
8,857,681 B2 * 10/2014 Burnett ..... A44B 11/005 24/3.1
8,919,396 B2 * 12/2014 Nieves ..... A45C 3/06 224/582
8,919,622 B1 * 12/2014 Gabriel ..... A45F 5/021 224/159
9,717,308 B2 * 8/2017 Bowerman ..... A44B 11/02
11,472,218 B1 * 10/2022 Thibodeaux ..... A45C 13/002
11,564,481 B2 * 1/2023 Hanchett ..... A45F 5/02
11,596,215 B2 * 3/2023 Suyama ..... A45F 3/02
2007/0017942 A1 * 1/2007 Hubbell ..... A45F 3/00 224/652
2007/0051765 A1 * 3/2007 Hsieh ..... A45C 5/14 190/110
2007/0099469 A1 * 5/2007 Sorensen ..... A45F 5/02 439/289
2007/0125815 A1 * 6/2007 Tong ..... A45F 4/02 224/583
2007/0261977 A1 * 11/2007 Sakai ..... A45C 13/008 206/315.11
2011/0240493 A1 * 10/2011 Adams ..... A45F 5/02 224/183
2012/0085802 A1 * 4/2012 Ferrante ..... F41C 33/046 224/625
2014/0301672 A1 * 10/2014 Bowerman ..... A45C 7/0086 24/457
2016/0095406 A1 * 4/2016 Bowerman ..... A45F 3/00 24/664
2016/0381447 A1 * 12/2016 Kattine ..... H04R 1/105 224/183
2018/0228260 A1 * 8/2018 Cole ..... A45C 11/00
2018/0228261 A1 * 8/2018 Cole ..... A45C 13/02
2018/0332937 A1 * 11/2018 Shayne ..... A45C 7/0086
2022/0079317 A1 * 3/2022 Cole ..... A45C 13/02

FOREIGN PATENT DOCUMENTS

DE 102015108935 A1 * 12/2016 ..... A45C 11/008
EP 3545791 A1 * 10/2019 ..... A45C 13/30
FR 2577771 A1 * 8/1986
GB 840343 A * 7/1960
JP 3230916 U * 2/2021 ..... A45C 13/008
WO WO-0013546 A1 * 3/2000 ..... A45C 13/30
WO WO-2013067303 A1 * 5/2013 ..... A44B 11/02

* cited by examiner

BAG SET AND USAGE METHOD THEREOF

BACKGROUND OF THE INVENTION

(1) Field of the Invention

The present invention relates to a bag set and usage method thereof, in particular, to a bag set suitable for use in water playing places.

(2) Description of the Prior Art

When people go to water-play areas such as swimming pools, beaches, etc., they may carry documents, cameras, mobile phones, even money or more important personal belongings. For fear of getting wet, most of people put these personal belongings in the car or in the safe deposit box of the water-play areas when they play in the water. However, the belongings in the safe deposit boxes are often stolen or lost, and the belongings in the car are not convenient to take out and use at any time. For many people who like to play in water, this is a troublesome problem.

In order to solve the above-mentioned problem, some manufacturers have developed waterproof backpacks for users to put their belongings in to carry with them. However, general waterproof backpacks need to be carried on the back of the user, so the waterproof backpacks must be detached from the user's body before the user takes out his belongings from the waterproof backpacks. In addition, most waterproof backpacks are treated by stitching the fabrics together along their folds or edges, so they usually only have the function of repelling water but are not suitable to use underwater. When general waterproof backpacks are placed underwater, it is difficult to prevent water from going inside through their folds or edges.

Among the personal belongings, mobile phones are often taken at any time in water-play areas. If mobile phones are placed in a waterproof backpack with other personal belongings, it is quite inconvenient to take them out immediately and quickly. Some manufacturers have developed waterproof mobile phone bags for this purpose. A general waterproof mobile phone bag has a transparent part, and has waterproof and airtight design in structure. It is convenient for users to carry electronic products such as mobile phones in rainy day, waterside play or even snorkeling. But the general waterproof mobile phone bag is not suitable to put too many other personal belongings in because its volume is just slightly larger than a mobile phone.

In order to meet the needs of waterproof and convenience, consumers need to purchase not only a waterproof backpack to store personal belongings other than mobile phones, but also a waterproof mobile phone bag to separately store a mobile phone. However, in actual use, users usually don't like to carry both the waterproof backpack and the waterproof mobile phone bag at the same time. They may carry only the waterproof mobile phone bag for convenience but sacrifice the safety of other belongings; or put all belongings together with the mobile phones in one waterproof backpack but sacrifice the convenience of using the mobile phone.

To sum up, the general waterproof backpacks are only water-resistant, water-repellent or rain-proof, so they are not suitable to be used underwater. On the other hand, general waterproof mobile phone bags often need to be used independently in the water, so it is not suitable to load too many other personal belongings. Accordingly, if a bag is capable of using underwater and combining the convenience of using the mobile phone with the safety of other belongings, it may be widely used by consumers when they play in the water.

SUMMARY OF THE INVENTION

One object of the present invention is to provide a bag set capable of waterproofing and being bound with the user closely underwater, and allowing the mobile phone to be quickly detached from and attached with other belongings at any time.

In order to achieve the aforementioned object, the present invention provides a bag set comprising a first bag unit and a second bag unit without straps. The first bag unit includes a main bag body and a strap set. The main bag body has two opposite sides and the strap set is connected between the two opposite sides of the main bag body. And the main bag body has a waterproof outer surface and two first fasteners disposed on the waterproof outer surface. The second bag unit has a waterproof rear surface and a waterproof front surface opposite to each other, and a transparent part for a user to operate an electronic device placed inside the second bag unit from outside thereof. The waterproof rear surface has two second fasteners to combine with the two first fasteners correspondingly, wherein the two second fasteners are selectively disassembled from the two first fasteners. When the two second fasteners are combined with the two first fasteners, the waterproof rear surface of the second bag unit is fixed on the waterproof outer surface of the first bag unit.

In an embodiment, the first bag unit has a first fused edge formed on the waterproof outer surface, and the second bag unit has a second fused edge connected between the waterproof rear surface and the waterproof front surface. The first bag unit and the second bag unit are capable of preventing water from going inside through the first fused edge and the second fused edge respectively when the bag set is under a pressure of one meter underwater.

In an embodiment, the strap set of the first bag unit comprises a first connecting end, a second connecting end and a third connecting end. The first connecting end is connected with one of the two opposite sides of the main bag body. Both of the second connecting end and the third connecting end are connected with another of the two opposite sides.

In an embodiment, the strap set of the first bag unit comprises a first strap component and a second strap component, wherein the first bag unit has a first ring and a second ring respectively disposed at the two opposite sides, wherein the first strap component has two connecting ends suitable to be attached to the first ring and the second ring respectively, wherein the second is strap component has one connecting end suitable to be attached to the first ring, and has another end including a loop structure for the first strap component to pass through.

Accordingly, the present invention provides a method of using the bag set with the strap set. The method comprises steps of: positioning the bag set under one arm of the user, so as to make the first ring behind the arm; hanging diagonally the first strap component on a shoulder connected with the other one arm of the user; extending forward the second strap component from the first ring and going around underside of the other arm to make the loop structure positioned in front side of the user; and passing the first strap component through the loop structure.

In an embodiment, the two first fasteners and the two second fasteners are magnetic fasteners. Each of the two first fasteners has a socket, and each of the two second fasteners has a protrusion for inserting into the socket. The socket of each of the two first fasteners has a movable latch to fix the protrusion in the socket when the protrusion of each of the two second fasteners is inserted into the socket. The movable latch retracts into an inner wall of the socket when the movable latch is pushed by the protrusion in the process of inserting the protrusion into the socket, then the movable latch automatically protrudes from the inner wall as the protrusion is completely inserted into the socket.

In an embodiment, the first bag unit has a form of a side bag. The second bag unit has a waterproof zipper disposed on the waterproof front surface.

The present invention uses two bag units such as a side bag and a mobile phone bag to form a bag set. The user can put important personal belongings in the side bag and a mobile phone alone in the mobile phone bag. When the user needs to use the mobile phone, he can separate the mobile phone bag from the side bag quickly, and attach it to the surface of the side bag immediately after use. In this way, both the convenience of using the mobile phone and the safety of other personal belongings can be considered.

DESCRIPTION OF THE PREFERRED EMBODIMENTS

Regarding technical contents, features and effects disclosed above and other technical contents, features and effects of the present invention will be clearly presented and manifested in the following detailed description of the exemplary preferred embodiments with reference to the accompanying drawings which form a part hereof.

Figure 1:
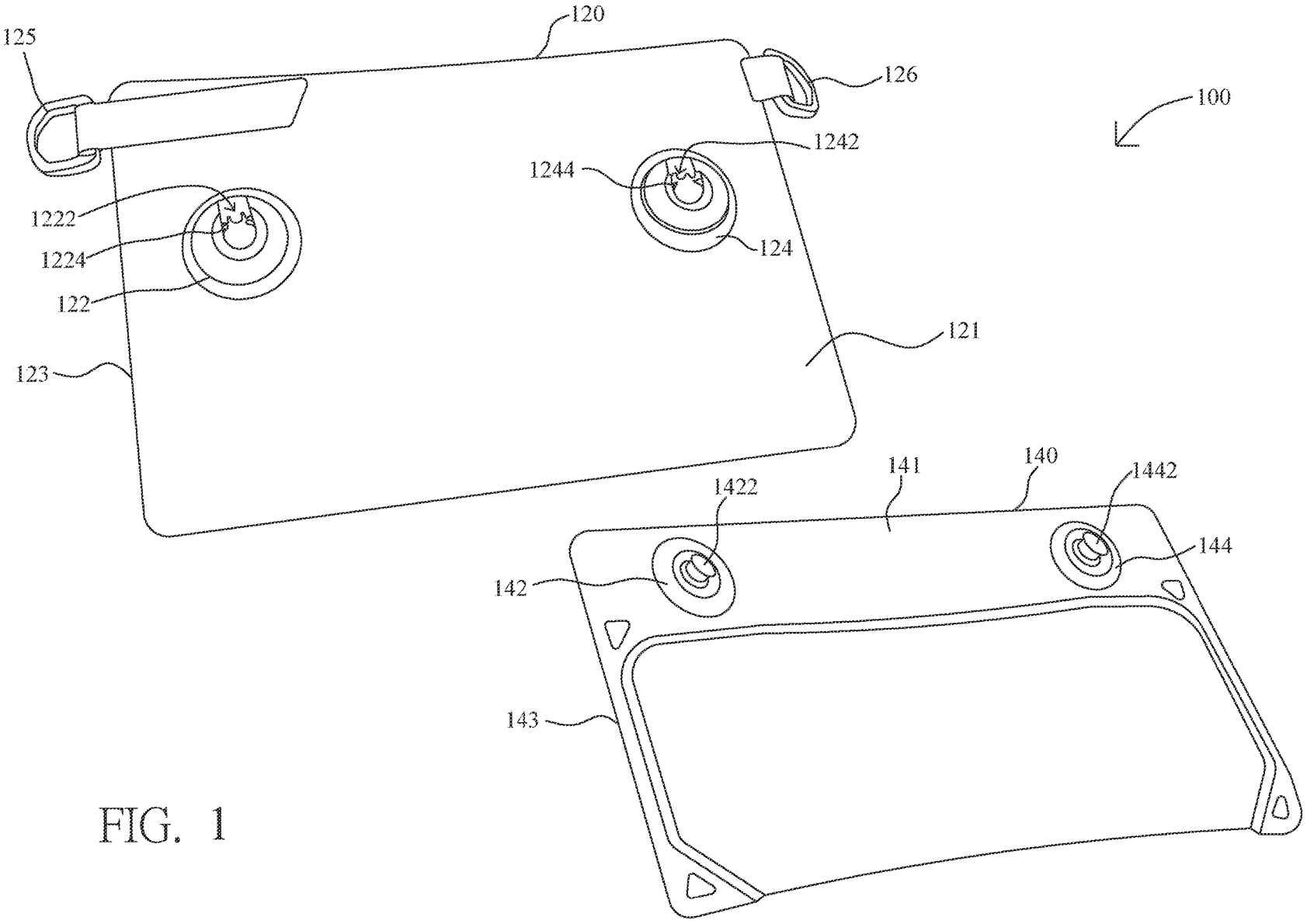
FIG. 1 is the schematic view of one embodiment to show the disassembly of a bag set including a mobile phone bag with a rear surface according to the present invention.
Figure 2:
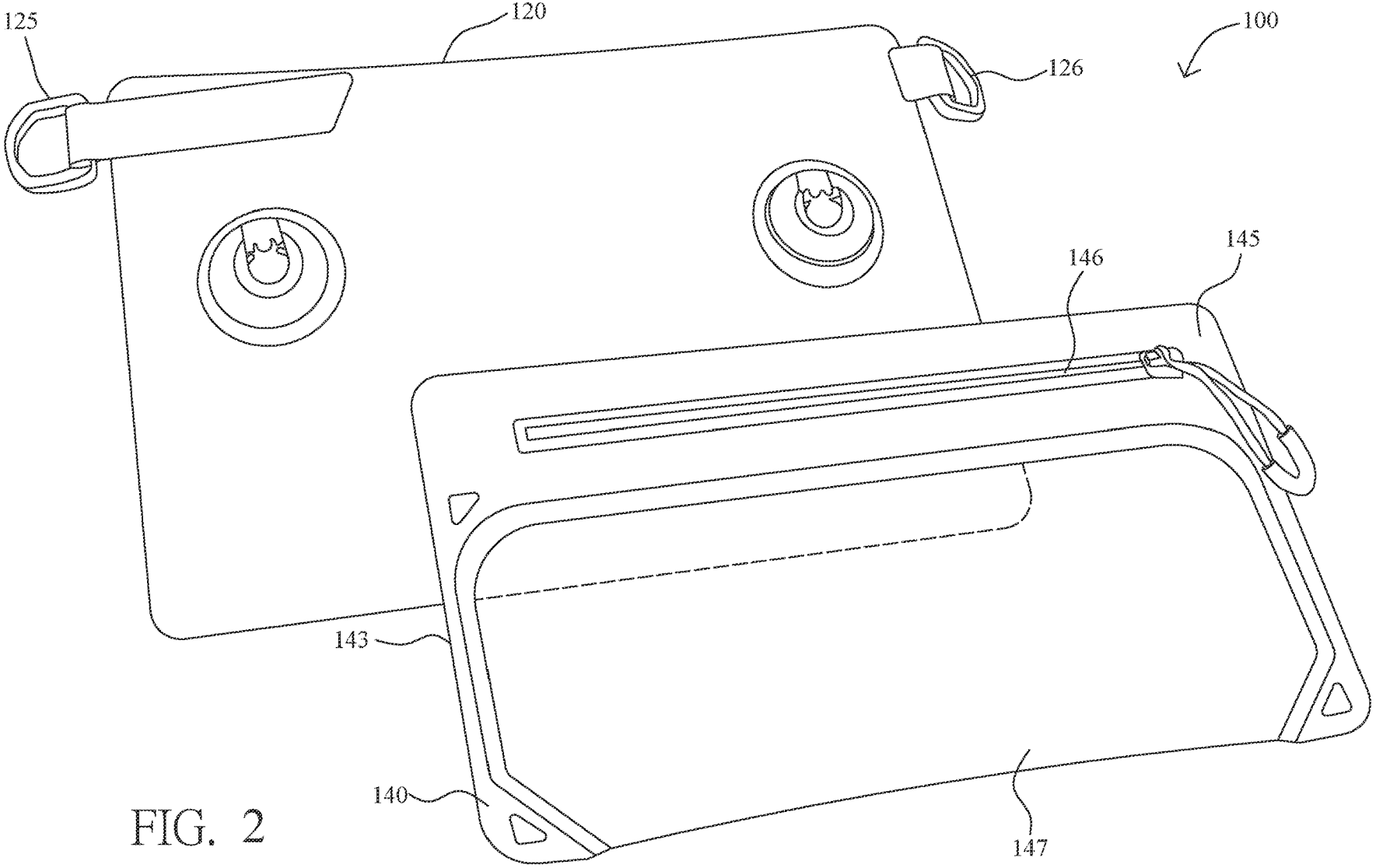
FIG. 2 is the schematic view of one embodiment to show the disassembly of a bag set including a mobile phone bag with a front surface according to the present invention.

FIGS. 1 and 2 are disassembly of a bag set according to an embodiment of the present invention. The bag set 100 is formed by combining a first bag unit with a second bag unit, and the second bag unit can be selectively detached from the first bag unit. In an embodiment, the first bag unit has a form as a side bag including a main bag body 120 and a strap set 160 shown in FIG. 4. The second bag unit is a mobile phone bag 140. Note that the mobile phone bag 140 has no straps. Both the main bag body 120 and the mobile phone bag 140 are made of waterproof fabric. The main bag body 120 has a waterproof outer surface 121 and a first fused edge 123 formed as an edge of the waterproof outer surface 121, and the mobile phone bag 140 has a second fused edge 143. The first and second fused edges 123, 143 are both formed by fusing two layers of waterproof fabrics together through a high frequency fusing process, to provide the functions of sealing and waterproofing for the main bag body 120 and the mobile phone bag 140 respectively. Therefore, the main bag body 120 and the mobile phone bag 140 are capable of preventing water from going inside through the first fused edge 123 and the second fused edge 143 respectively when the bag set 100 is under a pressure of one meter underwater. In other words, a whole of the bag set 100 can be used under the water surface and can withstand the water pressure of one meter below the water surface. In another embodiment, the main bag body 120 or/and the mobile phone bag 140 may be made of materials with different waterproof levels, or non-waterproof materials. In addition, the materials of the main bag body 120 and the mobile phone bag 140 may be the same or different.

The main bag body 120 has two first fasteners 122 and 124 disposed on the waterproof outer surface 121. The main bag body 120 has a top portion including a waterproof zipper (not shown in FIG. 1). There are a first ring 125 and a second ring 126 disposed respectively at two opposite sides of the top portion of the main bag body 120. The mobile phone bag 140 has a waterproof rear surface 141 (as shown in FIG. 1) and a waterproof front surface 145 (as shown in FIG. 2) opposite to each other. The second fused edge 143 is connected between the waterproof rear surface 141 and the waterproof front surface 145. On the waterproof rear surface 141 are disposed two second fasteners 142 and 144. After the mobile phone bag 140 shown as FIG. 1 is turned over, the two second fasteners 142 and 144 can be correspondingly combined with the two first fasteners 124 and 122 of the main bag body 120, and detached from the two first fasteners 124 and 122 selectively. In this way, the mobile phone bag 140 and the main bag body 120 are combined into the whole of the bag set 100, and can be separated to use independently as needed at any time.

In one embodiment, the two first fasteners 122, 124 and the two second fasteners 144, 142 are magnetic fasteners. The two first fasteners 122, 124 are attracted to the two second fasteners 144, 142 by magnetic force, respectively. Structurally, the two first fasteners 122 and 124 are both female fasteners, and have two sockets 1222 and 1242 respectively. The two second fasteners 142 and 144 are both male fasteners, and have two protrusions 1422 and 1442 like convex posts respectively for corresponding insertion into the two sockets 1242 and 1222. The two sockets 1222 and 1242 of the two first fasteners 122 and 124 have movable latches 1224 and 1244 respectively. The movable latches 1224 and 1244 can be retracted into the inner walls of the sockets 1222 and 1242 respectively, or automatically protrude from the inner walls of the sockets 1222 and 1242 respectively.

In the process of inserting the protrusions 1422 and 1442 of the two second fasteners 142 and 144 into the sockets 1242 and 1222 correspondingly, the protrusions 1422 and 1442 push the movable latches 1244 and 1224 respectively, so that the movable latches 1244 and 1224 retract into the inner walls of the sockets 1242 and 1222 temporarily. As the two protrusions 1422 and 1442 are completely inserted into the corresponding sockets 1242 and 1222, the movable latches 1244 and 1224 will automatically protrude from the inner walls of the sockets 1242 and 1222 respectively, to make the protrusions 1422 and 1222 fixed and locked in the corresponding sockets 1242 and 1222. With the magnetic force and the fastening structure, the mobile phone bag 140 is not easy to fall off the waterproof outer surface 121 of the main bag body 120.

As shown in FIG. 2, the mobile phone bag 140 has a waterproof zipper 146 on its waterproof front surface 145, and a transparent part 147 for the user to directly operate the mobile phone placed inside the mobile phone bag 140 from outside thereof to take pictures. The two second fasteners 142 and 144 are located on the back of the waterproof zipper 146 and above the transparent part 147.

Figure 3:
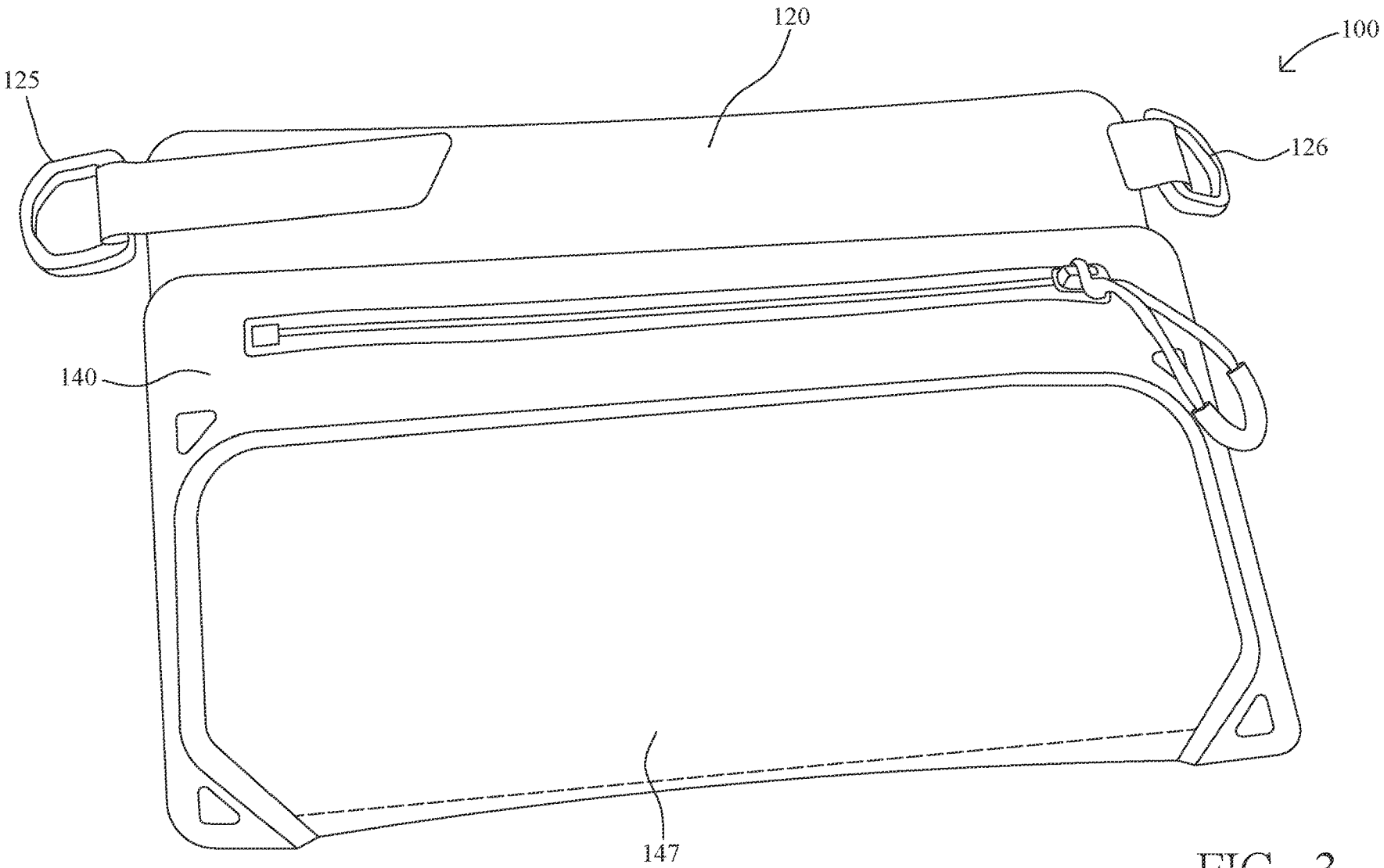
FIG. 3 is a schematic view of one embodiment to show a combination of a side bag and a mobile phone bag according to the present invention.

FIG. 3 is a combination of the main bag body 120 and the mobile phone bag 140 into the bag set 100. By combining the two second fasteners 142, 144 with the two first fasteners 124, 122 correspondingly, the waterproof rear surface 141 of the mobile phone bag 140 is fixed on the waterproof outer surface 121 of the main bag body 120. When in use, a strap (not shown in FIG. 3) is provided to attach its two ends to the two rings 125, 126 at the two opposite sides of the main bag body 120 respectively, so that the bag set 100 can be placed at a side of waist of a user by making the strap go around a shoulder of the user and cross diagonally his body. The user can put important personal belongings in the main bag body 120, and put the mobile phone in the mobile phone bag 140 alone. When the mobile phone needs to be used, the mobile phone bag 140 can be taken off immediately, and fixed on the surface of the main bag body 120 immediately after use. In this way, the user can obtain the convenience of using the mobile phone and take care of the safety of other personal belongings at the same time.

Figure 4:
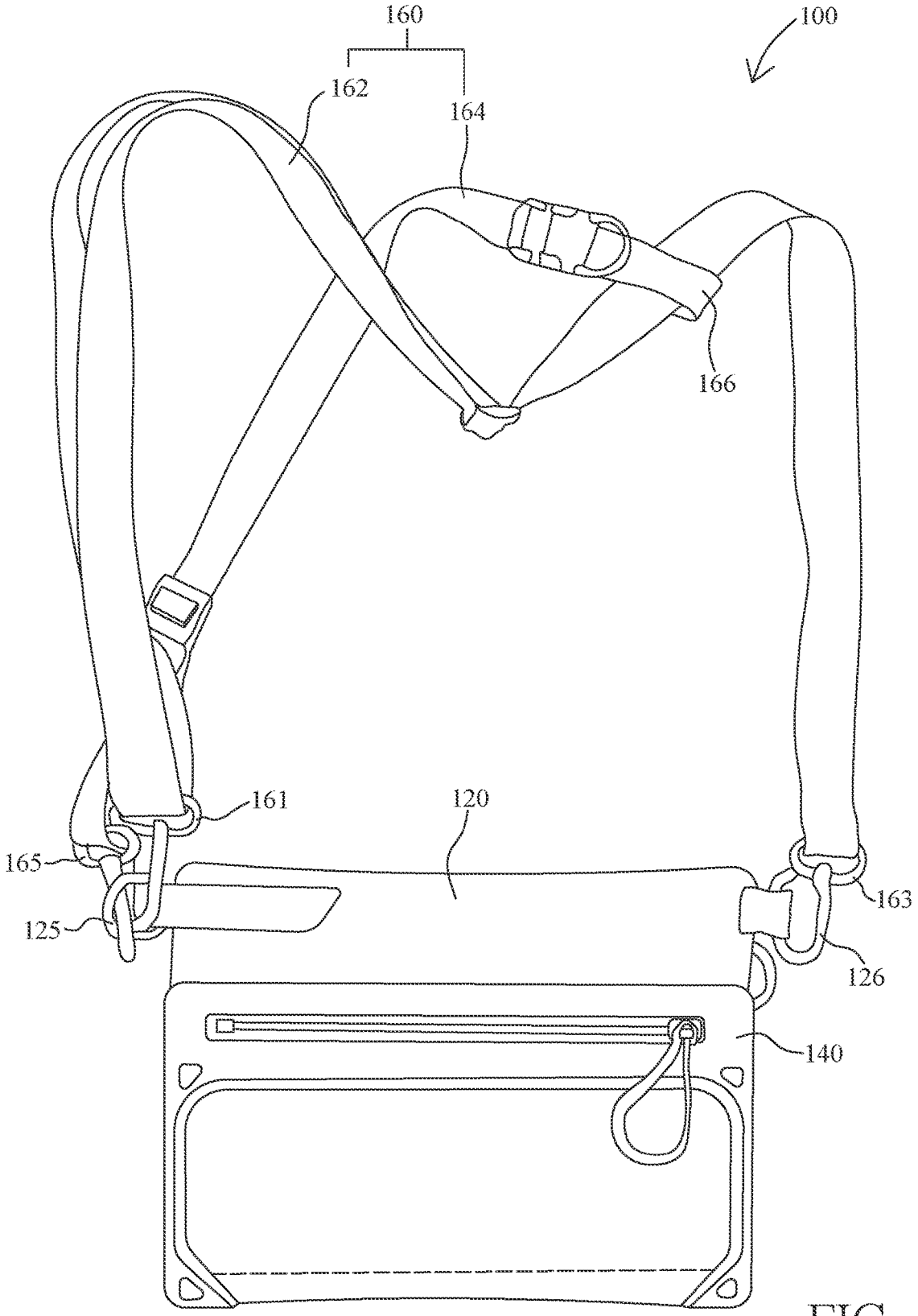
FIG. 4 is a schematic view of one embodiment to show a bag set with a strap set according to the present invention.

FIG. 4 shows a bag set 100 with a strap set 160. In an embodiment, the two opposite sides of the main bag body 120 have a first ring 125 and a second ring 126 respectively. The strap set 160 includes a first strap component 162 and a second strap component 164. The first strap component 162 has two connecting ends 161 and 163 suitable for being attached to the first ring 125 and the second ring 126 respectively. The second strap component 164 has one connecting end 165 suitable for being attached to the first ring 125. The other end of the second strap component 164 includes a loop structure 166 for the first strap component 162 to pass through.

Figure 5:
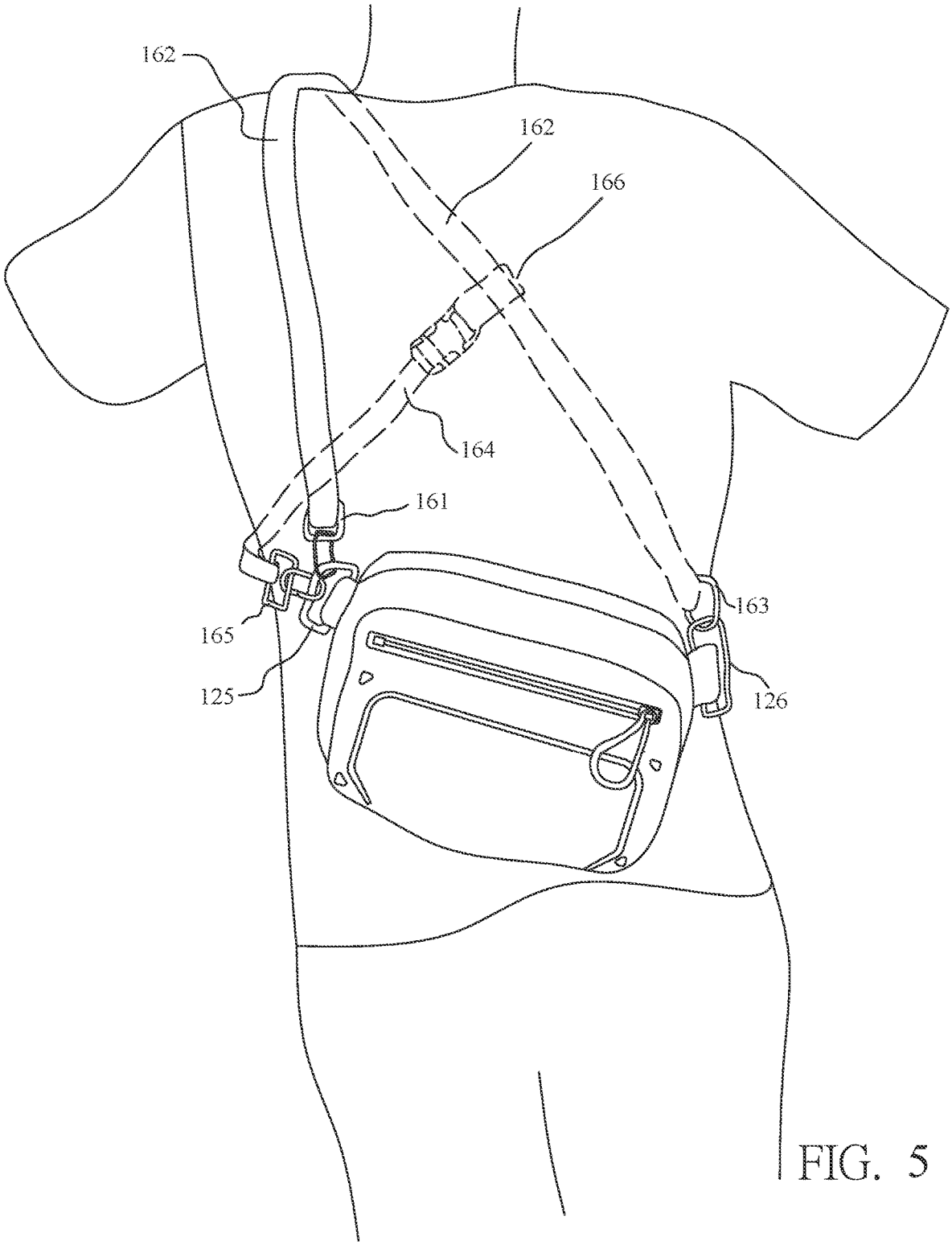
FIG. 5 is a schematic view showing a manner of use of an embodiment of a bag set with a strap set according to the present invention.

The first strap component 162 can be used independently or in conjunction with the second strap component 164. In an example of use, referring to FIGS. 4 and 5, the first strap component 162 goes around the left shoulder of the user and cross diagonally his body, to place the bag set 100 at right side of the user's waist. Subsequently, the second strap component 164 traverses the front side of the waist. Specifically, the user may position the bag set 100 under his right arm or at right side of his waist and let the main bag body 120 positioned between his body and the mobile phone bag 140, so as to make the first ring 125 behind the right arm or at right back of his waist; hang diagonally the first strap component 162 on his left shoulder; subsequently, extend the second strap component 164 forward from the first ring 125 and go around underside of his left arm or left side of his waist to make the loop structure 166 positioned at front side of his body; and pass the first strap component 162 through the loop structure 166; at last, adjust the length of the first strap component 162 and the second strap component 164 to bind the user's body, so as to fix the bag set 100 at right side of his waist closely. In other words, the first strap component 162 and the second strap component 164 have a form like a car seat belt for tying around the user's body. In this way, the bag set 100 can be more closely fitted and fixed on the waist of the user more stably.

The foregoing descriptions of the preferred embodiments of the present invention have been provided for the purposes of illustration and explanations. It is not intended to be exclusive or to confine the invention to the precise form or to the disclosed exemplary embodiments. Accordingly, the foregoing descriptions should be regarded as illustrative rather than restrictive. Obviously, many modifications and variations will be apparent to professionals skilled in this art. The embodiments are chosen and described in order to best explain the principles of the invention and its best mode for practical applications, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like is not necessary to confine the scope defined by the claims to a specific embodiment, and the reference to particularly preferred exemplary embodiments of the invention does not imply a limitation on the invention, and no such limitation is to be is inferred. The invention is limited only by the spirit and scope of the claims. The abstract of the disclosure is provided to comply with the rules on the requirement of an abstract for the purpose of conducting survey on patent documents, and should not be used to interpret or limit the scope or meaning of the claims. Any advantages and benefits described hereto may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A bag set comprising:

a first bag unit, including a main bag body and a strap set, wherein the main bag body has two opposite sides and the strap set is connected between the two opposite sides of the main bag body, wherein the main bag body has a waterproof outer surface and two first fasteners disposed on the waterproof outer surface; and a second bag unit, having no straps, and having a waterproof rear surface and a waterproof front surface opposite to each other, and a transparent part for a user to operate an electronic device placed inside the second bag unit from outside thereof, wherein the waterproof rear surface has two second fasteners to combine with the two first fasteners correspondingly, wherein the two second fasteners are selectively disassembled from the two first fasteners, and wherein the waterproof rear surface of the second bag unit is fixed on the waterproof outer surface of the first bag unit when the two second fasteners are combined with the two first fasteners;

wherein the two first fasteners and the two second fasteners are magnetic fasteners;

wherein each of the two first fasteners has a socket, and each of the two second fasteners has a protrusion for inserting into the socket; and wherein the socket of each of the two first fasteners has a movable latch to fix the protrusion in the socket when the protrusion of each of the two second fasteners is inserted into the socket.

2. The bag set according to claim 1, wherein the first bag unit has a first fused edge formed on the waterproof outer surface, and the second bag unit has a second fused edge connected between the waterproof rear surface and the waterproof front surface.

3. The bag set according to claim 2, wherein the first bag unit and the second bag unit are capable of preventing water from going inside through the first fused edge and the second fused edge respectively when the bag set is under a pressure of one meter underwater.

4. The bag set according to claim 1, wherein the strap set of the first bag unit comprises a first connecting end, a second connecting end and a third connecting end, wherein the first connecting end is connected with one of the two opposite sides of the main bag body, and both of the second connecting end and the third connecting end are connected with another of the two opposite sides.

5. The bag set according to claim 1, wherein the strap set of the first bag unit comprises a first strap component and a second strap component, wherein the first bag unit has a first ring and a second ring respectively disposed at the two opposite sides, wherein the first strap component has two connecting ends suitable to be attached to the first ring and the second ring respectively, wherein the second strap component has one connecting end suitable to be attached to the first ring, and has another end including a loop structure for the first strap component to pass through.

6. The bag set according to claim 1, wherein the movable latch retracts into an inner wall of the socket when the movable latch is pushed by the protrusion in the process of inserting the protrusion into the socket, then the movable latch automatically protrudes from the inner wall as the protrusion is completely inserted into the socket.

7. The bag set according to claim 1, wherein the first bag unit has a form of a side bag.

8. The bag set according to claim 7, wherein the second bag unit has a waterproof zipper disposed on the waterproof front surface.

9. A usage method of a bag set comprising a first bag unit, including a main bag body and a strap set, wherein the main bag body has two opposite sides and the strap set is connected between the two opposite sides of the main bag body, wherein the main bag body has a waterproof outer surface and two first fasteners disposed on the waterproof outer surface; and a second bag unit, having no straps, and having a waterproof rear surface and a waterproof front surface opposite to each other, and a transparent part for a user to operate an electronic device placed inside the second bag unit from outside thereof, wherein the waterproof rear surface has two second fasteners to combine with the two first fasteners correspondingly, wherein the two second fasteners are selectively disassembled from the two first fasteners, and wherein the waterproof rear surface of the second bag unit is fixed on the waterproof outer surface of the first bag unit when the two second fasteners are combined with the two first fasteners, wherein the strap set of the first bag unit comprises a first strap component and a second strap component, wherein the first bag unit has a first ring and a second ring respectively disposed at the two opposite sides, wherein the first strap component has two connecting ends suitable to be attached to the first ring and the second ring respectively, wherein the second strap component has one connecting end suitable to be attached to the first ring, and has another end including a loop structure for the first strap component to pass through;

the method comprising steps of:

positioning the bag set under a first arm on a first side of the user's body, so as to position the first ring behind the first arm;

hanging the first strap component over a shoulder on a second side of the user's body opposite the first side, and extending the first strap component diagonally across the user's body;

extending the second strap component forward from the first ring around the user's body and under a second arm on the second side of the user's body to position the loop structure at the front of the user's body; and passing the first strap component through the loop structure.

* * * * *